US007151214B2

(12) United States Patent
Barry

(10) Patent No.: US 7,151,214 B2
(45) Date of Patent: Dec. 19, 2006

(54) INTERACTIVE MULTIMEDIA APPARATUS

(75) Inventor: James Anthony Barry, Dublin (IE)

(73) Assignee: Thurdis Developments Limited, Dublin (IE)

( * ) Notice: Subject to any disclaimer, the term of this patent is extended or adjusted under 35 U.S.C. 154(b) by 316 days.

(21) Appl. No.: 10/240,591

(22) PCT Filed: Apr. 9, 2001

(86) PCT No.: PCT/IE01/00046

§ 371 (c)(1),
(2), (4) Date: Oct. 2, 2002

(87) PCT Pub. No.: WO01/95052

PCT Pub. Date: Dec. 13, 2001

(65) Prior Publication Data

US 2003/0140770 A1 Jul. 31, 2003

(30) Foreign Application Priority Data

Apr. 7, 2000 (IE) ..... S2000/0260
Oct. 27, 2000 (IE) ..... S2000/0869

(51) Int. Cl.
*G10H 1/36* (2006.01)

(52) U.S. Cl. ..... 84/600; 84/634; 84/650

(58) Field of Classification Search ..... 84/600–602, 84/634–637, 650–652, 666–669; 434/307 A
See application file for complete search history.

(56) References Cited

U.S. PATENT DOCUMENTS 4,791,848 A * 12/1988 Blum, Jr. ..... 84/453
5,214,231 A * 5/1993 Ernst et al. ..... 84/652
5,300,723 A * 4/1994 Ito ..... 84/601
5,319,452 A * 6/1994 Funahashi ..... 725/116
5,408,914 A * 4/1995 Breitweiser et al. ..... 84/477 R
5,458,040 A * 10/1995 Lawrence, Jr. ..... 84/473
5,491,297 A * 2/1996 Johnson et al. ..... 84/609
5,506,371 A * 4/1996 Gillaspy ..... 84/699
5,510,129 A * 4/1996 Kim ..... 426/62
5,600,082 A 2/1997 Torimura
5,690,496 A * 11/1997 Kennedy ..... 434/307 R (Continued)

OTHER PUBLICATIONS

Google: definition of "software", [online], [retrieved Feb. 6, 2005], Retrieved from the Google definition search engine at <URL:http://support.sbcglobal.net/general/662.shtml> See the fifth definition.*

*Primary Examiner*—Lincoln Donovan
*Assistant Examiner*—David S. Warren
(74) *Attorney, Agent, or Firm*—Hoffmann & Baron, LLP

(57) ABSTRACT

The apparatus (1) comprises a guitar (3) having strings (42) operable by a user to generate electric signals, a control unit (2), storage means for a simulation backing track in any desired multi-media file format and audio/audio-visual equipment for playing a main track. The control unit (2) has software for receiving and analyzing the electrical signals from the guitar (41) and for synchronizing the backing track with the main track during playback. The software of the control unit (2) opens the backing track multi-media file and streams the file in mute mode in synchronisation with the main track. In response to the electrical signals from the guitar (41), the control unit generates an output from the multi-media file to the audio/audio-visual equipment. Alternatively, the apparatus opens and plays extracts from the multi-media file and generates an output from the multi-media files to the audio equipment (4) together with the background track.

19 Claims, 10 Drawing Sheets

U.S. PATENT DOCUMENTS 5,739,457 A * 4/1998 Devecka ..... 84/743
5,773,742 A 6/1998 Eventoff et al.
5,777,251 A * 7/1998 Hotta et al. ..... 84/609
5,908,997 A * 6/1999 Arnold et al. ..... 84/615
5,915,288 A * 6/1999 Gabriel ..... 84/609
5,925,843 A * 7/1999 Miller et al. ..... 84/609
5,967,792 A 10/1999 Matsumoto
5,990,405 A * 11/1999 Auten et al. ..... 84/609
6,018,121 A * 1/2000 Devecka ..... 84/743
6,063,994 A * 5/2000 Kew et al. ..... 84/600
6,075,197 A * 6/2000 Chan ..... 84/730
6,175,070 B1 1/2001 Naples et al.
6,425,822 B1 * 7/2002 Hayashida et al. ..... 463/7

* cited by examiner

INTERACTIVE MULTIMEDIA APPARATUS

FIELD OF THE INVENTION

The present invention relates to an interactive multimedia apparatus.

BACKGROUND OF THE INVENTION

Schoolchildren, teenagers and even adults are often seen with a brush, hockey stick or tennis racket in their hand strumming along to a guitar track in the background. This is known as playing the "Air Guitar". Simulating the playing and movements of the Guitarist with the "Air Guitar" is a very important part of the musical experience, especially to songs with strong instrumental tracks. The users can fantasise and imagine themselves as the lead or bass guitarist playing in the company of their idols. Air Guitarists, however, have only a limited enjoyment experience as their action and movements do not influence the sound output in any way. There is clearly a need for a method of providing a user with a greatly enhanced musical and emotional experience using an "Air Guitar" or other "Air Instrument" when played in this way.

U.S. Pat. No. 5,990,405 (Gibson Guitar Corp) discloses a system for generating and controlling a simulated musical experience in which a musician can simulate participation in a concert by playing a musical instrument and wearing a head-mounted 3D display that includes stereo speakers. Audio and video portions of a musical concert are pre-recorded, along with a separate sound track corresponding to the musical instrument played by the musician. Playback of the instrument sound track is controlled by signals generated in the musical instrument and transmitted to a system interface connected to the audio-video play back device, an audio mixer and the lead mounted display. The instrument sound track can be suppressed so that that actual sound generated by the musician playing the musical instrument can be heard with the pre-recorded audio and video portions.

The Gibson Guitar system is a specific hardware apparatus designed for use by an experienced musician and presupposes that the user will have access to a mixing console or decoder capable of separating a backing track audio from the composite audio. The input device is a standard electric guitar which produces analog audio signal outputs. Therefore this system is not suitable for use by an "Air Guitarist" and cannot be directed to a mass market of persons who appreciate music but have no musical training.

SUMMARY OF THE INVENTION

Accordingly, there is provided an interactive multimedia apparatus comprising:

- a music simulation instrument having activation means operable by a user to generate electric signals in response to the user's activation and selection;
- a control unit;
- storage means for at least one simulation backing track in any desired multi-media file format;
- and audio/audio-visual means for playing a main track;
- the control unit having:
  - software for receiving and analyzing the electrical signals from the music simulation instrument; and
  - means for synchronizing the simulated backing track with the main track playing on the audio/audio-visual means during playback and for maintaining synchronization during playback;
- whereby in operation, the software of the control unit opens the backing track multi-media file and streams the file in mute mode in synchronisation with the main track, and whereby in response to the electrical signals from the music simulation instrument, the control unit generates an output from the multi-media file to an audio/audio-visual means This mode of operation of the apparatus is referred to as synchronised mode. The file must be available at the control unit and be retrievable by software stored in the control unit. Furthermore, it is essential that the backing track is being played to the speakers in synchronisation with the original track playing on the audio-visual unit. Therefore, the control unit must be connected directly to the audio-visual output to be assured of synchronisation.

Ideally, the control unit has input/output connections for the Internet.

Preferably, the multi-media is file downloadable in MP3 format, wav format or any other file format for storing audio information digitally.

Preferably, each file contains any individual instrumental track from a selection of available tracks whereby an operator may download a piece of music with any track removed and additionally download that track separately to play along with the piece of music. In a typical recording studio each musical element is recorded separately onto a digital track, e.g. track one—main vocals, track two—backing vocals, track three—rhythm guitar, track four—lead guitar, track five—bass guitar, track six—keyboards and so on. The tracks are merged as one mix in the final output of the song as it appears on a music CD. An operator may download a piece of music with any track removed and additionally download that track separately from the Internet to play along with the piece of music.

Ideally, the software in the control unit starts the main track and streams the backing track in mute synchronization with the main track and when the software receives an electrical signal from the music simulation instrument, the software outputs an audible signal from the multimedia file.

Preferably, the software in the control unit detects the length, and amplitude and/or frequency of the electrical signals received from the music simulation instrument and in which the software adjusts the output from the multi-media file to the audio/visual means as a direct response to the characteristics of the signal from the music simulation instrument.

Conveniently, the formatted file is generated by analysing the contents of the instrument-backing track of an album and recreating the notes and chords in any multi-media file format to (a) generate a file which will provide valid and meaningful output even during periods when the album backing track is silent.

(b) always generate an output even if the user operates the activation means at the wrong time or incorrectly; and in which the outputs provided in the event of (b) are sympathetic to the main track's structure and melody.

The means for analysing a master backing instrument track includes software and algorithms.

In a further aspect of the invention, there is provided an interactive multimedia apparatus comprising:

- a music simulation instrument having activation means operable by a user to generate electric signals in response to the user's activation and selection;
- a control unit;
- storage means for one or more multi-media files in any format;

and an audio/audio-visual means for playing a background track;

the control unit having:

software for receiving and analyzing electrical signals from the music simulation instrument; and means for opening and playing extracts from the multi-media files in response to the electrical signals, whereby in operation, the software of the control unit opens the selected multi-media files and generates an output from the multi-media files to the audio/audio-visual means together with the background track This mode of operation of the apparatus is referred to as standard mode and does not involve any software synchronisation between the sound generated by the software in response to an operator activating the instrument and the audible output from the main track through the audio-visual equipment.

Ideally, the multi-media files are played simultaneously with a CD, DVD or other primary source of music playing on the audio-visual equipment. Sound is generated in direct response to an operator's action, which enhances the overall musical experience for the operator.

Preferably, the means for opening and/or playing extracts from the multi-media file is operable by user activated controls members which send a signal to the software of the control unit in response to being pressed.

Ideally, each control member has an associated file stored on the control unit, whereby in use, the user activates a control member and the software opens the associated file and plays it directly or in response to the activation means of the music simulation instrument being operated.

Preferably, the apparatus is provided with a series of special effect controls which when operated by a user send signals to the software to produce a variety of special effects on the audio/audio-visual output. There are a variety of different ways of manipulating sounds using effects. Frequencies of samples can be raised or lowered, resonance can be distorted (overdrive) or echo can be added through delay and feedback.

Conveniently, the apparatus includes means for storing the newly generated output to any desired storage device such as a hard disk, a compact disc, a DVD device or the like.

Preferably the apparatus includes a series of visual display screens which are operable to enable a user to launch a game experience, select different operating modes, choose a source music device, select a backing track and/or assign digital sound effects files to the special effects controls on the music simulation instrument.

The music simulation instrument may be connected to a joystick port of a personal computer, games console or via a USB, RS232 port or the like.

Optionally, the multimedia file may contain a riff, a sample, a loop or a track. A riff is a series of notes that form a section of a musical track. A song might contain a guitar riff of eight notes followed by a series of guitar riffs to form a lead solo. Some software music studios have riff generators that allow the creation of unique riffs instead of using pre-recorded riffs. There are also different digital formats for riffs such as .wav and .mp3. A sample is a pre-recorded piece of music that is usually not very long such as a five-second bass riff, or a two-second drum loop. Many CD's are available that offer thousands of royalty-free sound samples. A loop is a riff that when repeated over and over again forms a seamless track of music. A bass loop may contain a six-note riff that can be repeated a number of times to form some of the bass-line of a song.

Preferably, the music simulation instrument comprises a guitar or a guitar type device in which the activation means operable by the user comprise a series of strings and a transducer to convert the strumming of the strings into electrical signals.

Conveniently, the guitar or guitar type device includes a control panel, selection controls, a volume control and the said special effect controls.

Ideally, the control panel allows a user to navigate through the software interface which is provided by a mask on the screen of the visual equipment. This allows the user the opportunity to remotely select a wide range of multi-media files at any time.

Ideally, the transducer is provided by a magnetic pick-up.

Preferably, the apparatus includes an interface for sending the electrical signals generated by the transducer to the control unit, the interface being provided between the transducer and the input port of the control unit, the interface unit enabling the user to generate a plurality of different control signals to the control unit.

Ideally, the interface includes an amplifier and level detectors to detect the force with which the user strums or strikes the strings. The software includes means to decipher the electrical signals from the instrument and generate a sound wave at the correct amplitude.

Ideally, the interface unit is provided with a potentiometer which varies the duration of the sound of the multimedia file.

Ideally, customised driver software is provided with the instrument avoiding the necessity for calibration.

Preferably, the music simulation instrument is connected to a Universal Serial Bus (USB) of the control unit.

In a further embodiment, the music simulation instrument is connectable to a microphone input/output connections of the control unit.

Preferably, the control unit comprises a personal computer, a cable or satellite television decoder or a games console and the audio/audio-visual means comprises a mono or stereo high fidelity audio apparatus, a television, a monitor or a like audio/audio-visual output means.

Preferably, the visual equipment of the control unit has options in the form of user interface screens allowing a user to remotely operate the entire multimedia apparatus with the control panel of the music simulation instrument.

Ideally, the options available to a user range from connecting to a website to selecting a variety of files available for downloading on the website.

Preferably, the music simulation instrument is used to control games.

In a still further aspect of the invention, an operator can use the music simulation instrument and the software interface as a sixteen or twenty-four track-recording studio. The studio allows an operator to save their compositions in a format for future synchronized play and also in a format for writing their own CD's. Other export formats are MP3 and wav.

Ideally, an operator can drop samples of riffs and loops onto individual tracks to compose their own music/songs. Bass loops, drum loops, rhythm guitar and lead guitar riffs and loops in different musical instruments are provided. Samples are available on CDs and can be downloaded from the net.

Preferably, the user will be able to set beats per minute BPM, create his own riffs, loops, and effects and change the pitch of selected sections. BPM stands for beats per minute and is also known as the tempo of a song, or in other words the speed at which a song is played. Different songs will have different BPM e.g. a lot of Techno/Dance/Hip-Hop will have 130–180 BPM. It is important when creating a song made up of sample riffs and loops that all the samples have the same BPM. Some software programs allow the transposition of samples from one tempo to another without changing the pitch of the sample.

Ideally, an operator uses the interface to create CD jewel box graphics that can be printed on any printer for distribution.

Ideally, a number of music simulation instruments can be connected to the control unit at one time allowing multi-user operation of the apparatus. One guitarist could control the lead guitar, another the base, and another the rhythm guitar and roles could be switched while playing. In Jam mode, players could improvise by playing over specially composed songs or by playing their own tracks/songs or by playing in random selection mode. In this mode a number of operators could have a 'battle of the bands' competition against each other.

In another aspect of the invention, an operator uses the apparatus as a learning aid and has to strum to the correct tempo of the music as well as making different track selections and adding the proper effects at the right time.

In a further aspect of the invention, the apparatus is used as a controller to bring the operator through different levels of a custom designed computer game. The game plot could go through different levels of becoming a rock star such as going to music school, learning to play, forming a band, writing songs, playing gigs, getting a manager, recording in a studio, getting a record deal, releasing an album, designing CD sleeves, making a pop/rock video, animations/clips etc, competing in the charts and all the various stages could be conducted as a competition over the Internet.

In a still further aspect of the invention, an operator selects any guitar chord and plays it by strumming the strings wherein the chords can be laid down in sequence and allocated to different buttons or combinations of buttons. Most guitar players write songs initially as a sequence of Chords. There are numerous music books available to give the guitar tablature (Chords) for different music albums/styles. These could also be provided through the web.

The present invention is a combination of digital hardware and computer software program. It operates on mass market computer-based multimedia platforms, i.e. personal computers or games consoles such as Sony Playstation, Microsoft X-Box or Nintendo Dreamcast (APS Registered Trade Marks).

The invention uses a proprietary computer gaming peripheral as the input device. This is a digital device that produces a series of digital switch outputs plus a binary digital output waveform related to the intensity by which simulated guitar strings are plucked. The strings are solely used as a triggering mechanism. The string vibration times can be electrically adjusted by potentiometers connected to a retriggerable monostable on the control board of the peripherals. The peripheral includes switches to allow the user navigate and make selections on their interface screen. Additional switches are provided on the peripheral for special sound and effect selection.

The musical content for use with the invention can be any third-party generated audio-only music that can be played on a personal computer or games console. Typically this will be popular album releases. A separate playback track is recorded not as part of the original recording. The original recording remains intact including the target playback instrument.

The separate track recording is 'packed' to ensure that it contains musical information even when the player hits the strings at the incorrect time.

The content also includes discrete soundbites (effects sounds, i.e. riffs, beats, loops etc. selectable by the switches on the peripheral) that can be triggered during the playback experience.

The delivery method for the instrument track is primarily internet based. Instrument playback soundtracks are prepared for selected popular album releases which users can download from a membership website. These digital sound files are delivered either as MP3 or WAV files. The original composite playback is typically sourced from pre-purchased CD album releases.

The invention utilises a digital time-slicing technique to control the volume of a pre-recorded instrument playback. A proprietary game input device generates a digital pulse for a user configurable time period. Two such digital signals are produced. One is produced when the game input device strings are plucked gently. When the strings are plucked more forcefully a second pulse signal is generated simultaneously although for a different time duration. In this manner, three possible instrument states are used: high, medium and off. These states are used to modify the instrument playback volume between these three states.

The invention is specifically a computer bases gaming solution. As such it requires a controlling computer software application. This software must perform the following tasks:

Input data—the gaming/digital input device connects to a personal computer or games console via the joystick or game port. The application must be able to read this data port.

Joystick/game port driver—to allow the application to read the joystick/game port, a unique and dedicated software driver is required. This is an interface between the user interface application, the computer operating system and the computer hardware. The driver monitors the digital state of the input device and passes this information to the user interface application.

User interface application—a series of computer screens are required that allow the user to launch the game experience, select different operating modes, choose the source music device, select a playalong track and assign digital sound effects files to effects buttons on the input instrument.

Synchronisation—a major concern of the computer program is to maintain synchronisation between the launch of the playback track and the source music device and to maintain this synchronisation during playback (source music may be delivered via CD or digital MP3 or WAV files).

Playback—the software program streams digital data packets (from source music, playback and effects files) to the internal sound card of the computer equipment. The relative volume and duration of these different data streams is controlled by the application relative to the inputs generated by the external gaming peripheral. Control and maintenance of the various data streams is a complex task requiring precise use and control of computer memory, hard disk, and sound peripherals.

The invention will now be described with reference to the accompanying drawings, which show, by way of example only, an interactive multimedia apparatus in accordance with the invention in which:

DETAILED DESCRIPTION OF THE PREFERRED EMBODIMENTS

Figure 1:
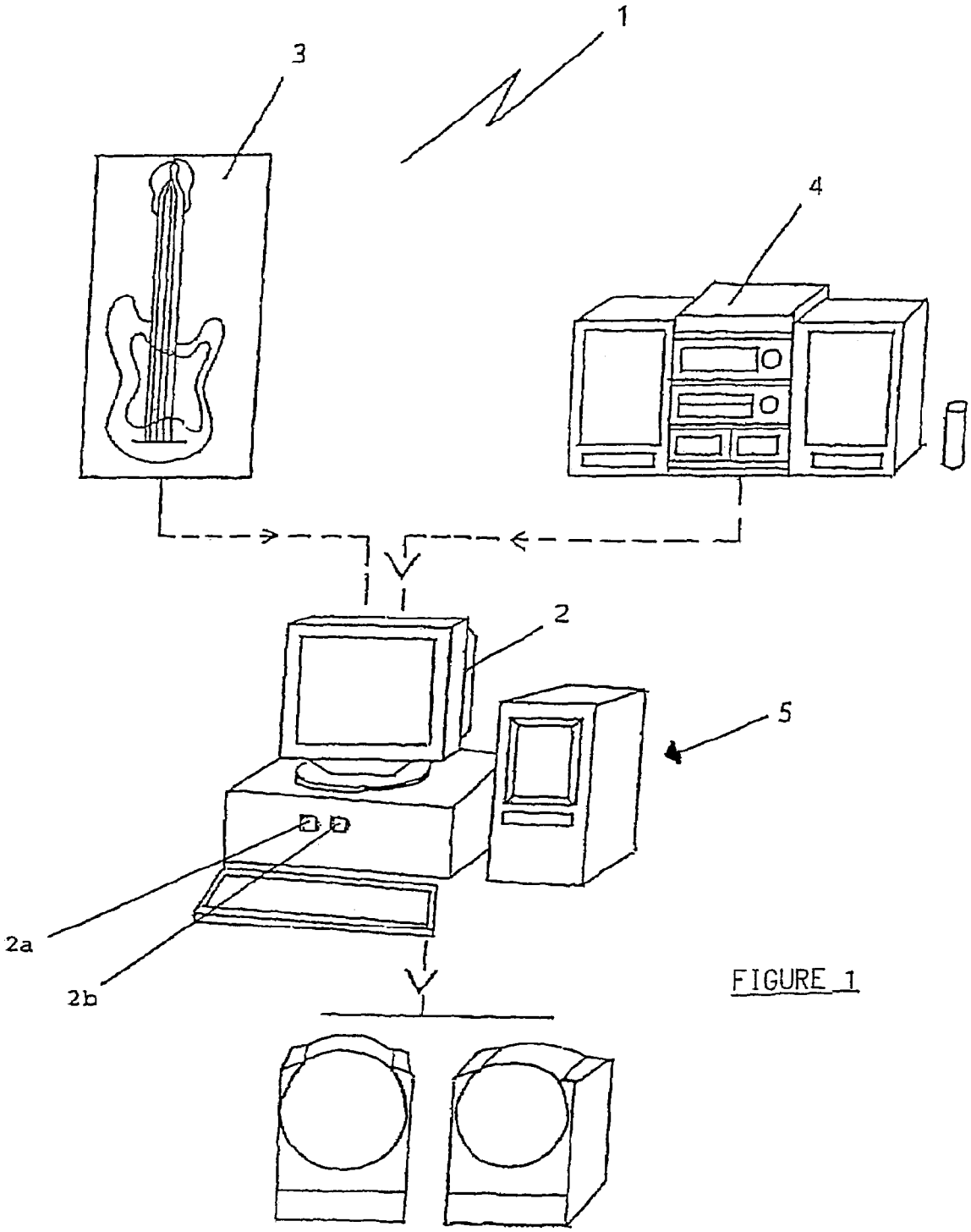
FIG. 1 is a pictorial representation of a first embodiment of interactive multimedia apparatus.

Referring to the drawings and initially to FIG. 1 there is shown an interactive multimedia apparatus indicated generally by the reference numeral 1. The apparatus 1 comprises a control unit provided by a PC 2 in this embodiment. The PC 2 can store any number of instrumental backing tracks in any desired file format on a hard drive and has I/O connections for a musical instrument provided by a guitar 3 in this embodiment. The PC 2 also has an I/O connection for audio-visual equipment provided by an audio unit 4 and Internet access via a modem 5.

Figure 2:
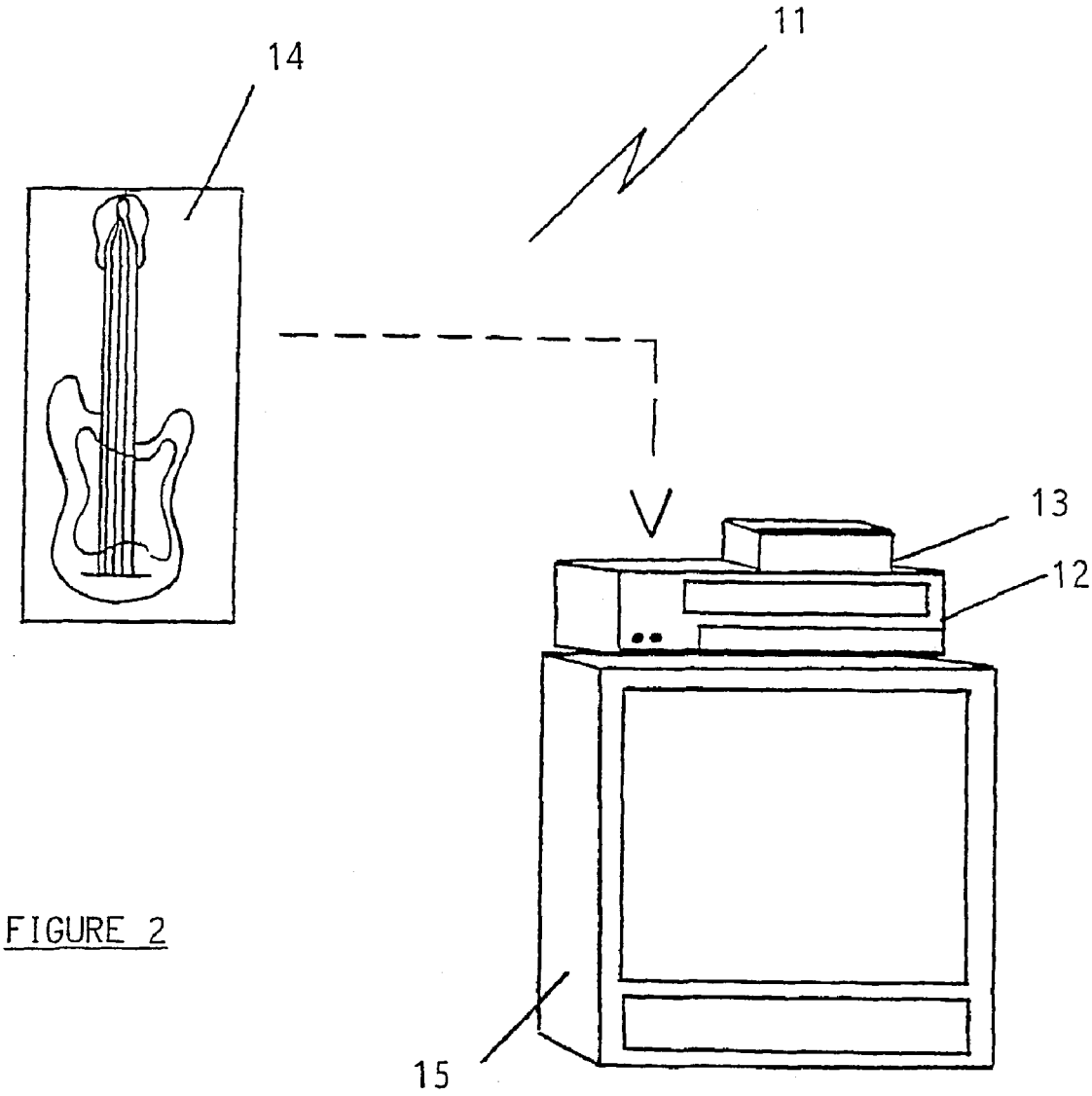
FIG. 2 is a pictorial representation of a second embodiment of the interactive multimedia apparatus.

Referring to the drawings and now to FIG. 2 there is shown a second embodiment of an interactive multimedia apparatus indicated generally by the reference numeral 11. The apparatus 11 comprises a control unit provided by a set top box 12 having a facility to store instrumental backing tracks downloaded over a cable TV modem 13 in conjunction with a main original track. In synchronisation mode, the control unit receives a start-up signal from a main track playing on the audio-visual equipment 15 and electrical signals from the guitar 14. In response to the start-up signal the software of the control unit opens the backing track multi-media file and plays the file in mute mode in synchronisation with the main track. In response to electrical signals from the guitar 14, the software of the control unit generates an audible output signal from the multimedia file to the audio-visual equipment 15 in direct response to an input from the user of the guitar 14. In standard mode, no start-up signal is received by the software of the control unit and multimedia files stored on the control unit are opened and played in direct response to electrical signals from the guitar 14.

Figure 3:
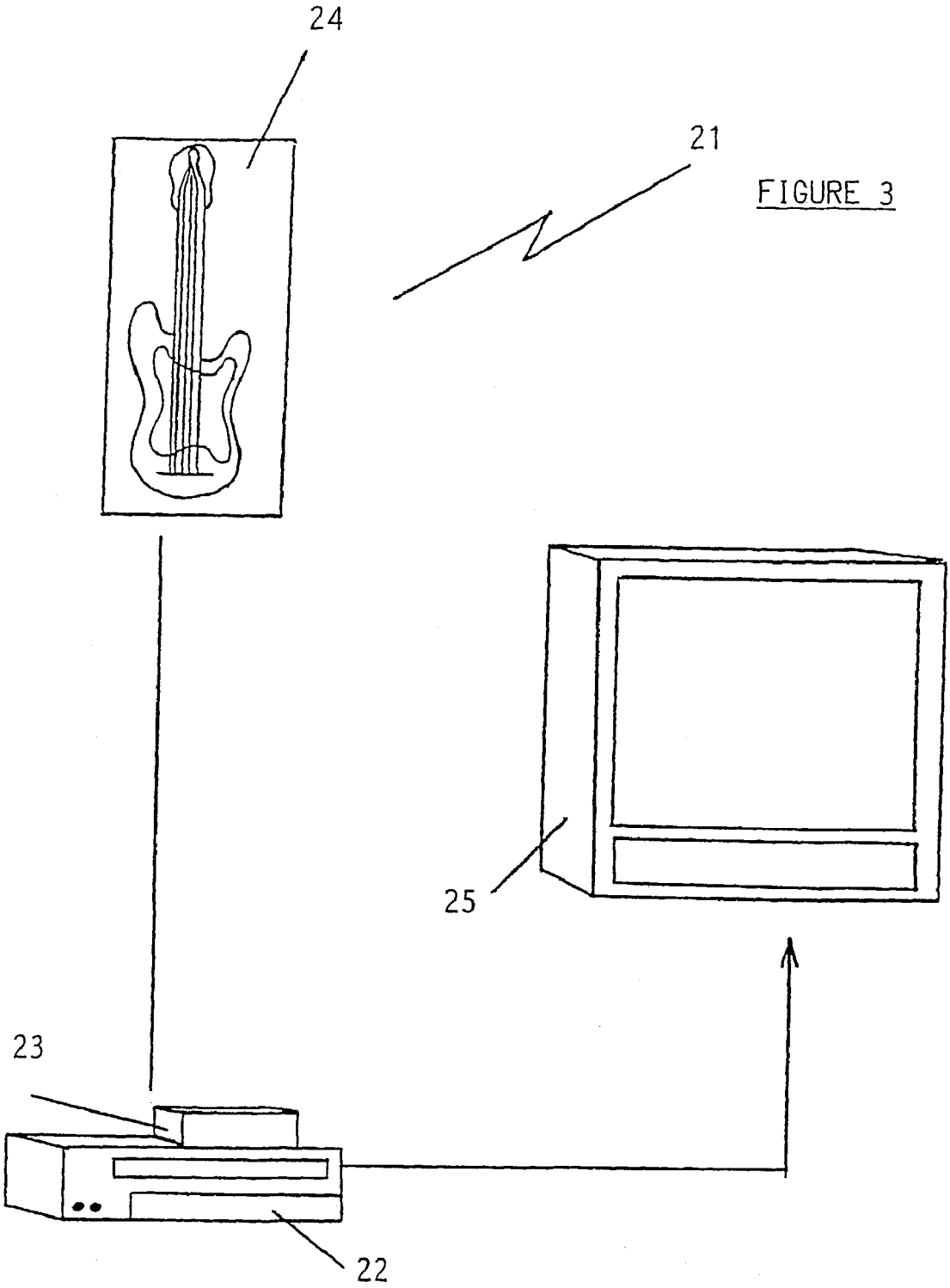
FIG. 3 is a pictorial representation of a third embodiment of the interactive multimedia apparatus.
Figure 4:
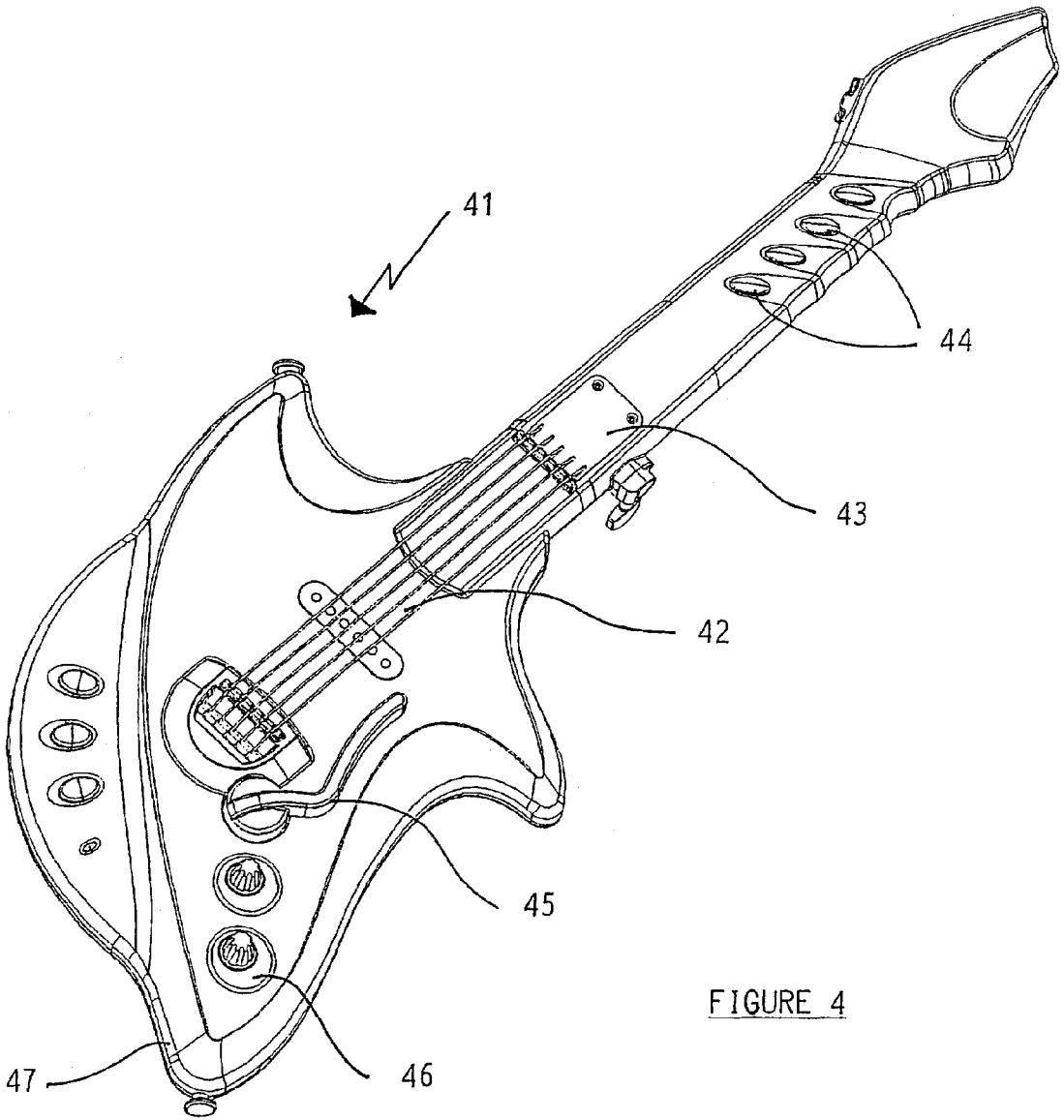
FIG. 4 is a perspective view of a music simulation instrument provided in this case by a guitar.
Figure 6:
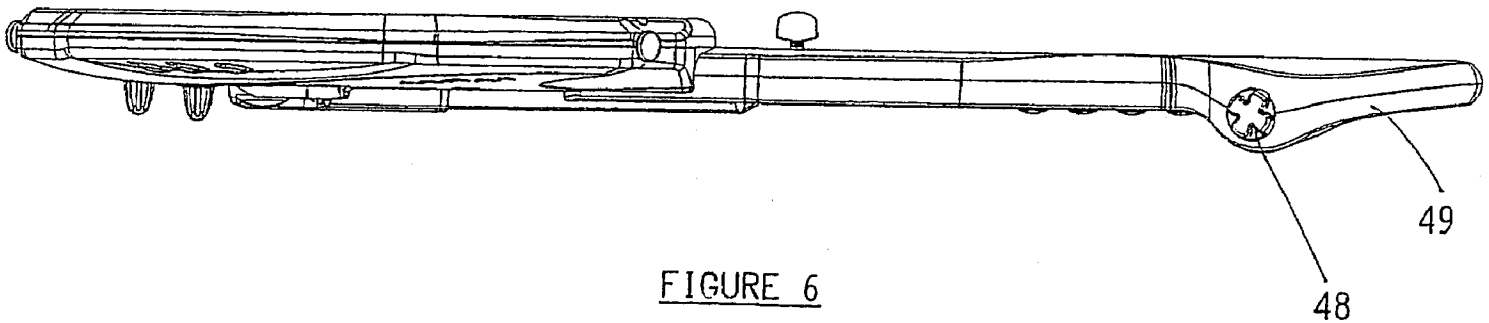
FIG. 6 is a side view of the guitar of FIGS. 4 and 5.
Figure 5:
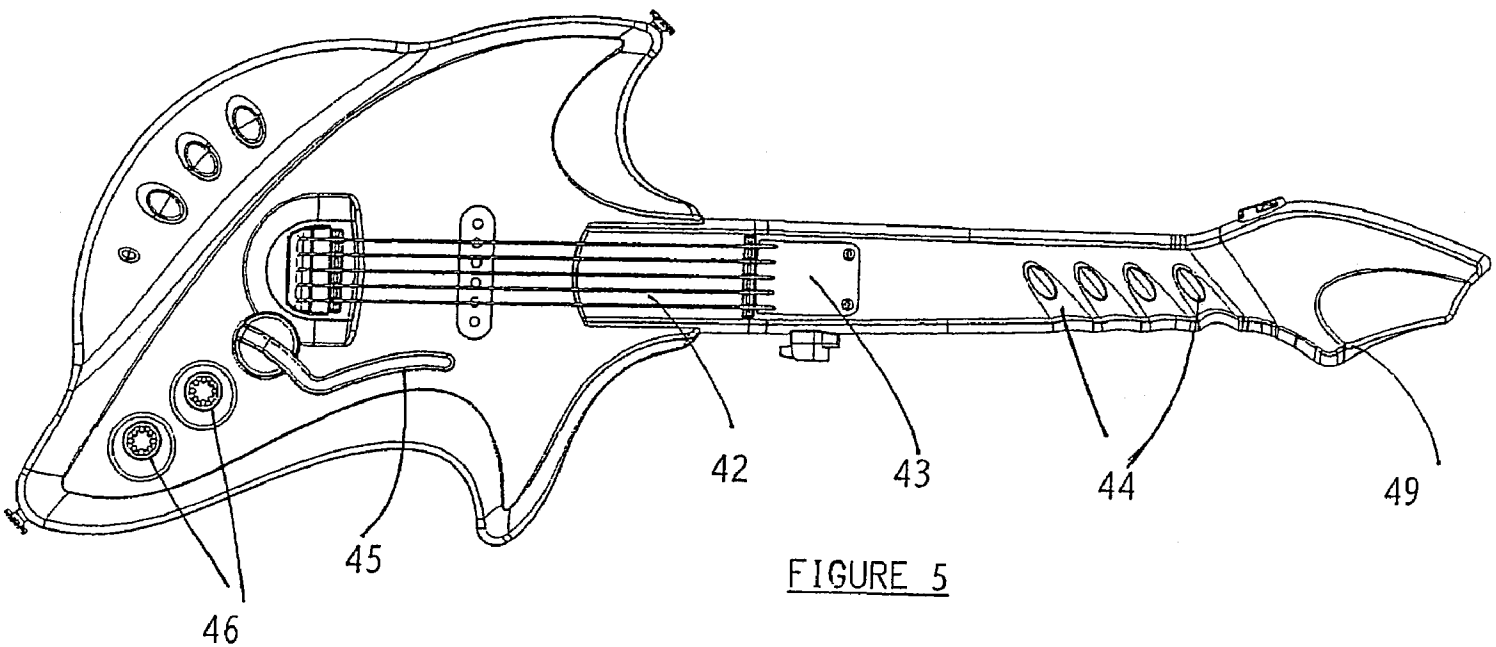
FIG. 5 is a front elevation view of the guitar of FIG. 4.
Figure 7:
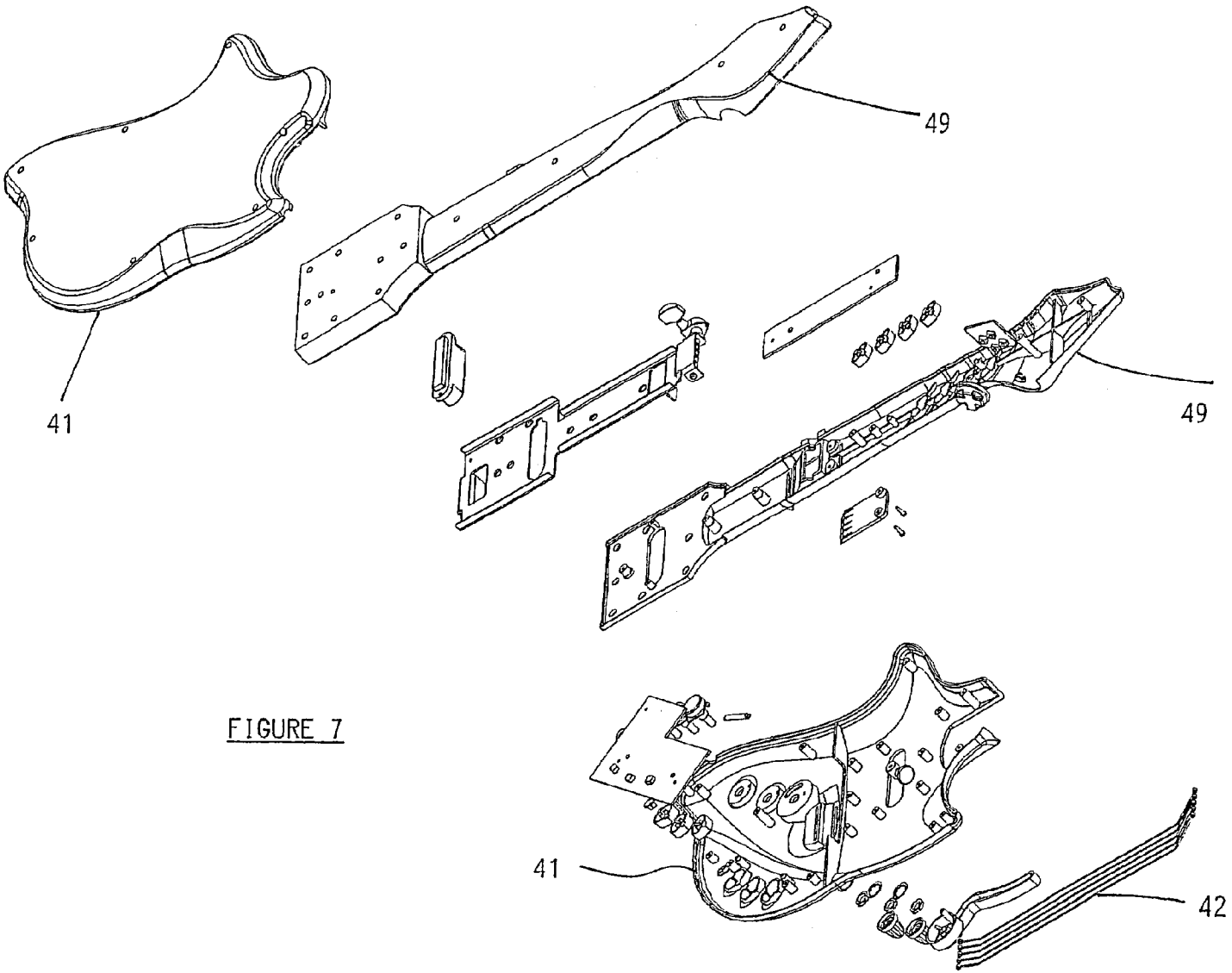
FIG. 7 is a rear exploded perspective view of the guitar of FIGS. 4, 5 and 6.

Referring to the drawings and now to FIG. 3 there is shown a third embodiment of an interactive multimedia apparatus indicated generally by the reference numeral 21. The apparatus 21 comprises a control unit provided by a games console 22 having a facility to store instrumental backing tracks downloaded over a modem 23 in conjunction with a main original track. In synchronisation mode, the games console 22 receives a start-up signal from a main track playing on the audio-visual equipment 25 and electrical signals from the guitar 24. In response to the start-up signal the software of the console 22 opens the backing track multi-media file and plays the file in mute mode in synchronisation with the main track. In response to electrical signals from the guitar 24, the software of the console 22 generates an audible output signal from the multimedia file to the audio-visual equipment 25 in direct response to input from the user of the guitar 24. In standard mode, no start-up signal is received by the software of the console 22 and multimedia files stored on the console 22 are opened and played in direct response to electrical signals from the guitar 24.

Referring to the drawings and now to FIGS. 4 to 7, there is shown one embodiment of a music simulation instrument provided in this case by a guitar 41. The guitar 41 is provided with strings 42 and a transducer 43. A number of selection buttons 44 are provided in addition to a tremolo arm 45 for pitch bending and creating a tremolo effect. A volume control button 46 and a power indicating L.E.D. 47 are also provided on the guitar 41. Also shown in FIGS. 5 to 7, a control pad 48 is provided at the end of the arm 49 of the guitar 41.

In use, a user strums the guitar 41 and the strings 42 vibrate up through the transducer 43. The transducer 43 converts the mechanical vibrations to an electrical signal and forwards the electrical signal to an interface unit 83 (see FIGS. 8 and 9). The interface unit 83 transmits the signal to the control unit and in particular to the software stored thereon. In response to electrical signals from the guitar and/or start-up signals from a music source playing on audio-visual equipment the software opens a file containing a variety of sounds stored digitally. The software combines the sound file with the sound output from the main track using a sound mixer.

Additionally, if a user wishes to output sound from a different file, a selection button 44 must be pressed on the guitar 41. This in turn signals the software to open a different associated file. If a user wishes to hear a special effect on the melody he can move the arm 45 and volume control is achievable by twisting volume control buttons 46. When a user becomes tired of the various files that they have downloaded onto the control unit, they may select a different collection of files using the control pad 48 in conjunction with a user interface screen displayed on the visual display. A user can directly access the internet using the guitar 41 as a means for navigation.

Figure 8:
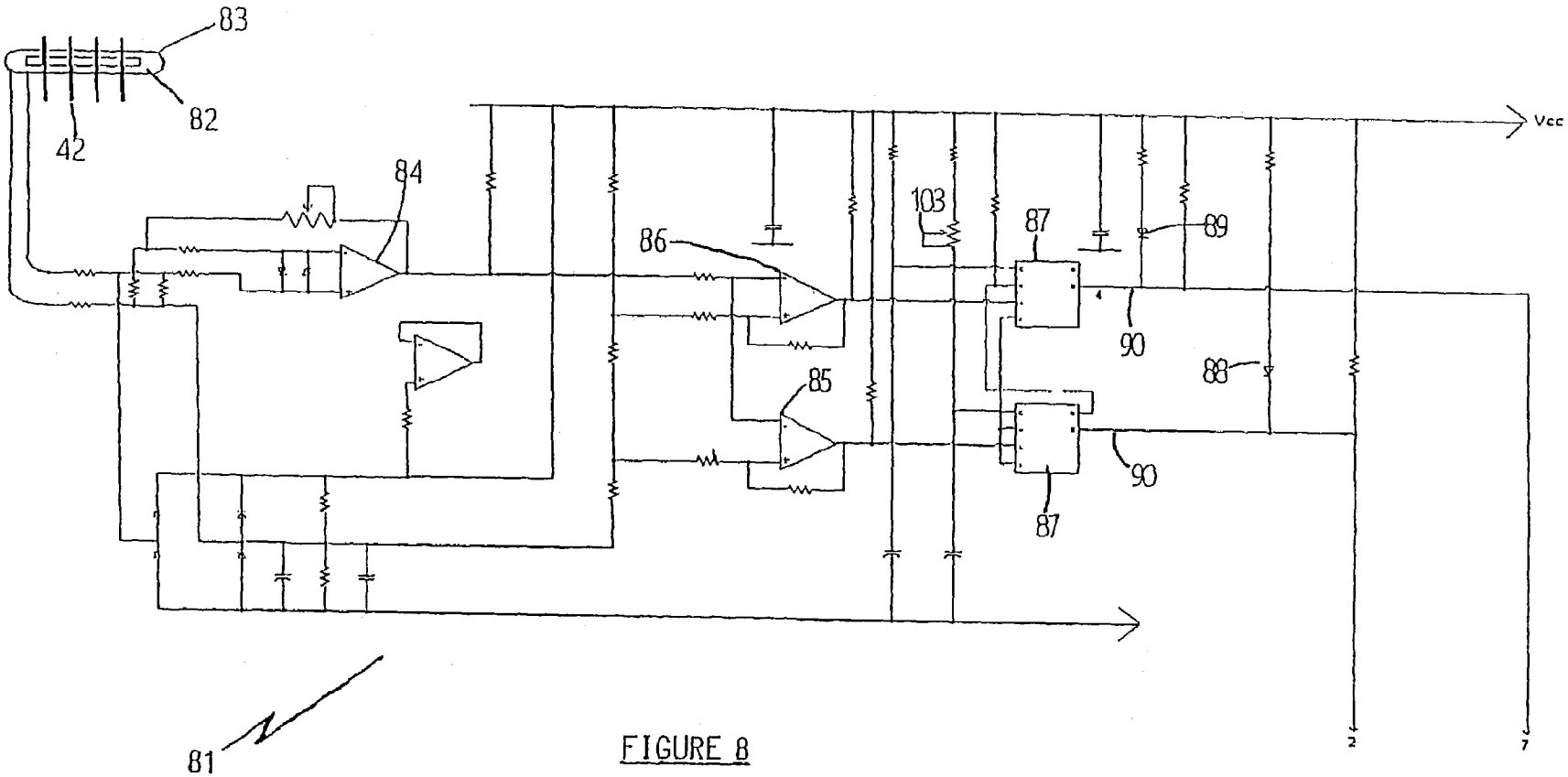
FIG. 8 is a schematic diagram of a section of the interface unit.

Referring to the drawings and now to FIG. 8, there is shown a schematic diagram for a section of the interface box indicated generally by the reference numeral 81. A magnetic pickup 83 connects the music simulation instrument to the input port/joystick port of a P.C. or games board. The magnetic pickup 83 uses a standard magnetic coil 82 and the movement of the metal strings 42 change the magnetic field of the magnetic coil 82 inducing an electromotive force (e.m.f.) in the coil surrounding the magnet. The signal is presented to a high gain operational amplifier 84 and passed on to two level detectors 85 and 86. When one predetermined voltage is reached in response to a certain force being applied to the strings 42 by an operator, level detector 85 switches and provides an input to the monostable 87. The output 90 from the monostable 87 goes to zero and turns the green L.E.D. 88 on resulting in pin 2 going to zero volts.

When the operational amplifier 84 sends a higher voltage to the level detectors 85 and 86, detector 86 switches and provides a signal to the monostable 87. The output 90 of the monostable 87 goes from five volts to zero volts and the red L.E.D. 89 comes on resulting in pin 7 going to zero volts. The P.C. or games board constantly monitors the values of the input on the joystick port by means of the bios. The software provided for the guitar reads the values stored in RAM by the bios and provides a relevant response, which in relation to pin numbers 2 and 7 is an audible sound. The length of the sound played depends on the reset time of the monostable 87 which is controllable by adjusting variable resistor 103. Additionally, the control system used to damp the vibration of the strings 42 can also effect the duration of the sound produced in response to an operator strumming the strings 42.

Figure 9:
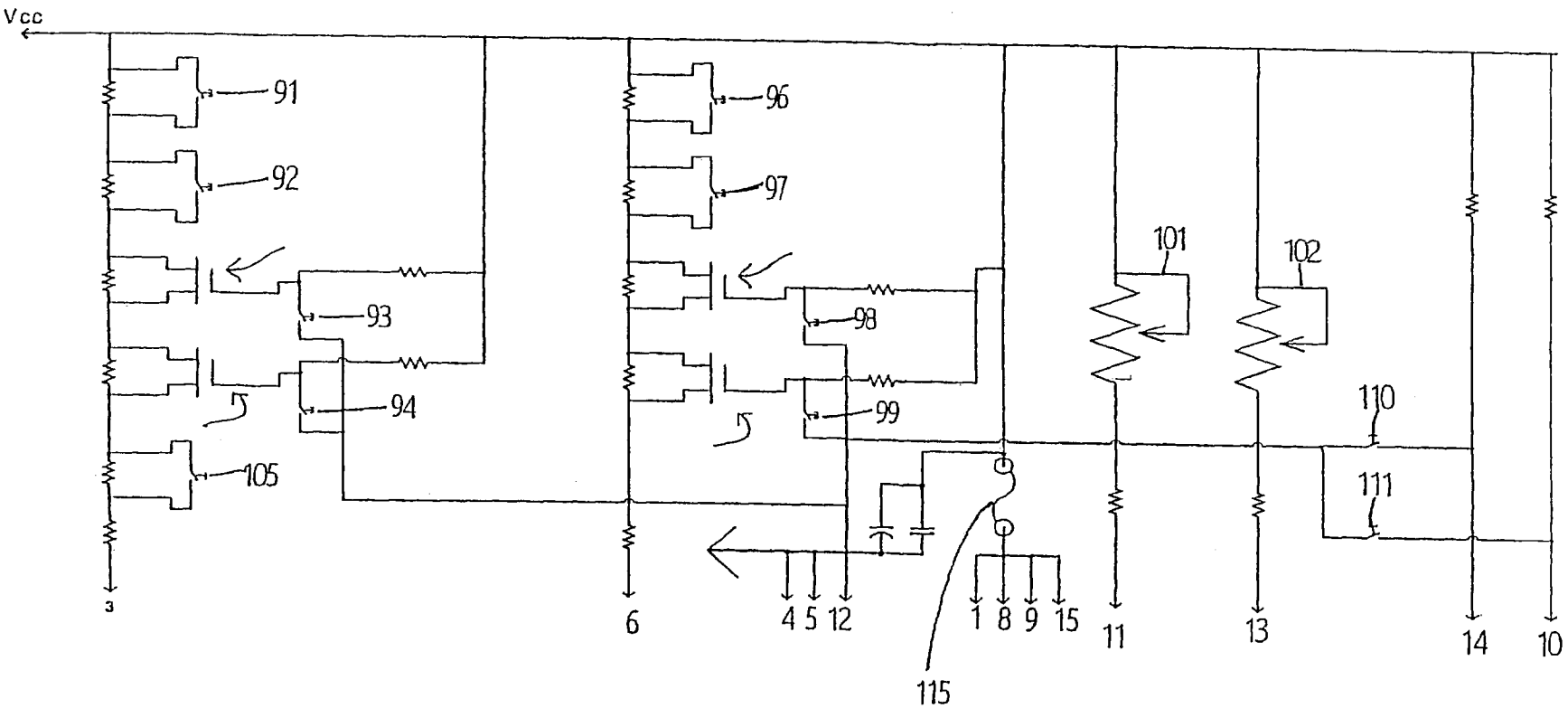
FIG. 9 is a schematic diagram of the remaining section of the interface unit.
Figure 10:
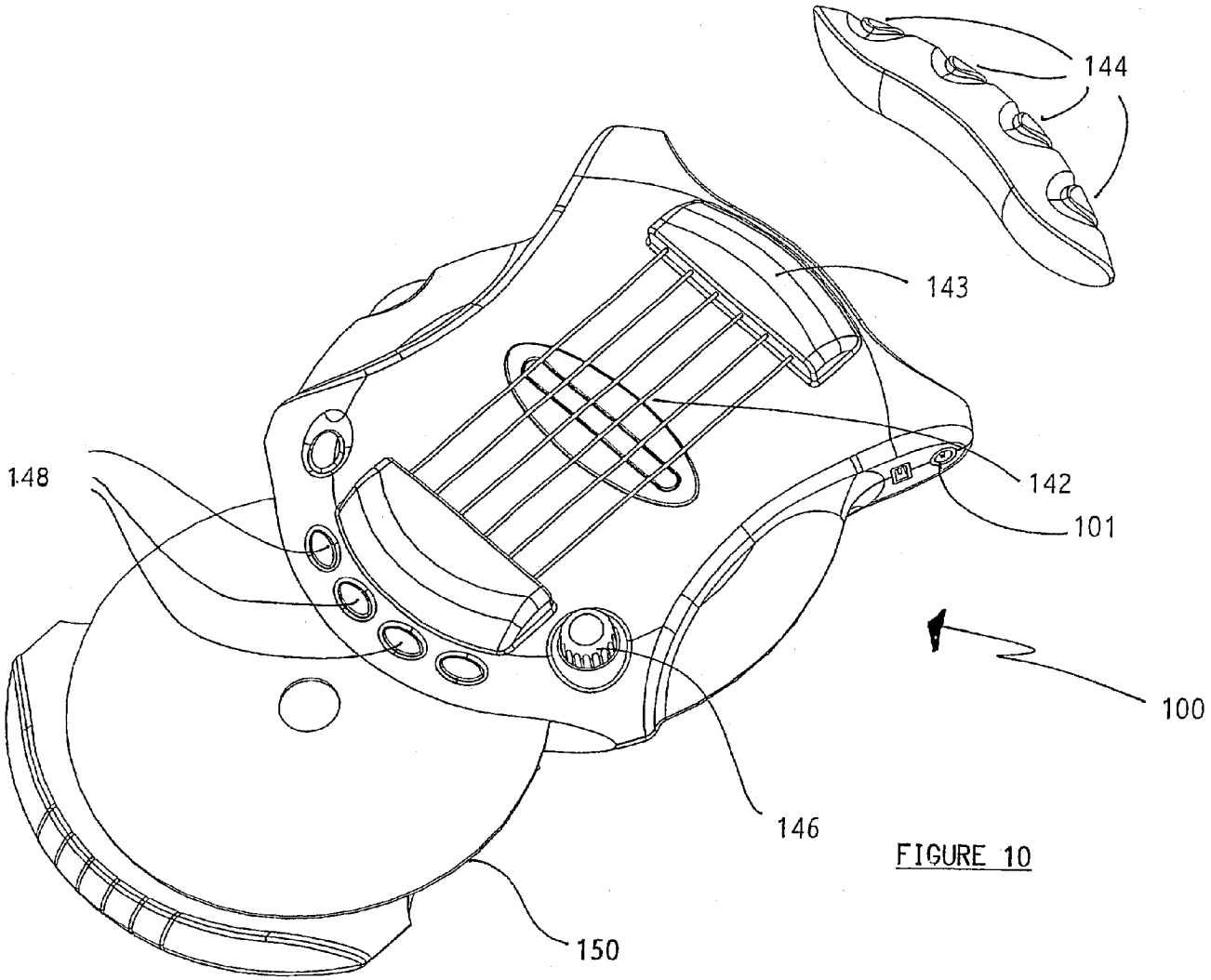
FIG. 10 is a partly exploded perspective view a further embodiment of an interactive multi-media apparatus which can be used as a portable unit.
Figures 11, 12, 13, 14, 15:
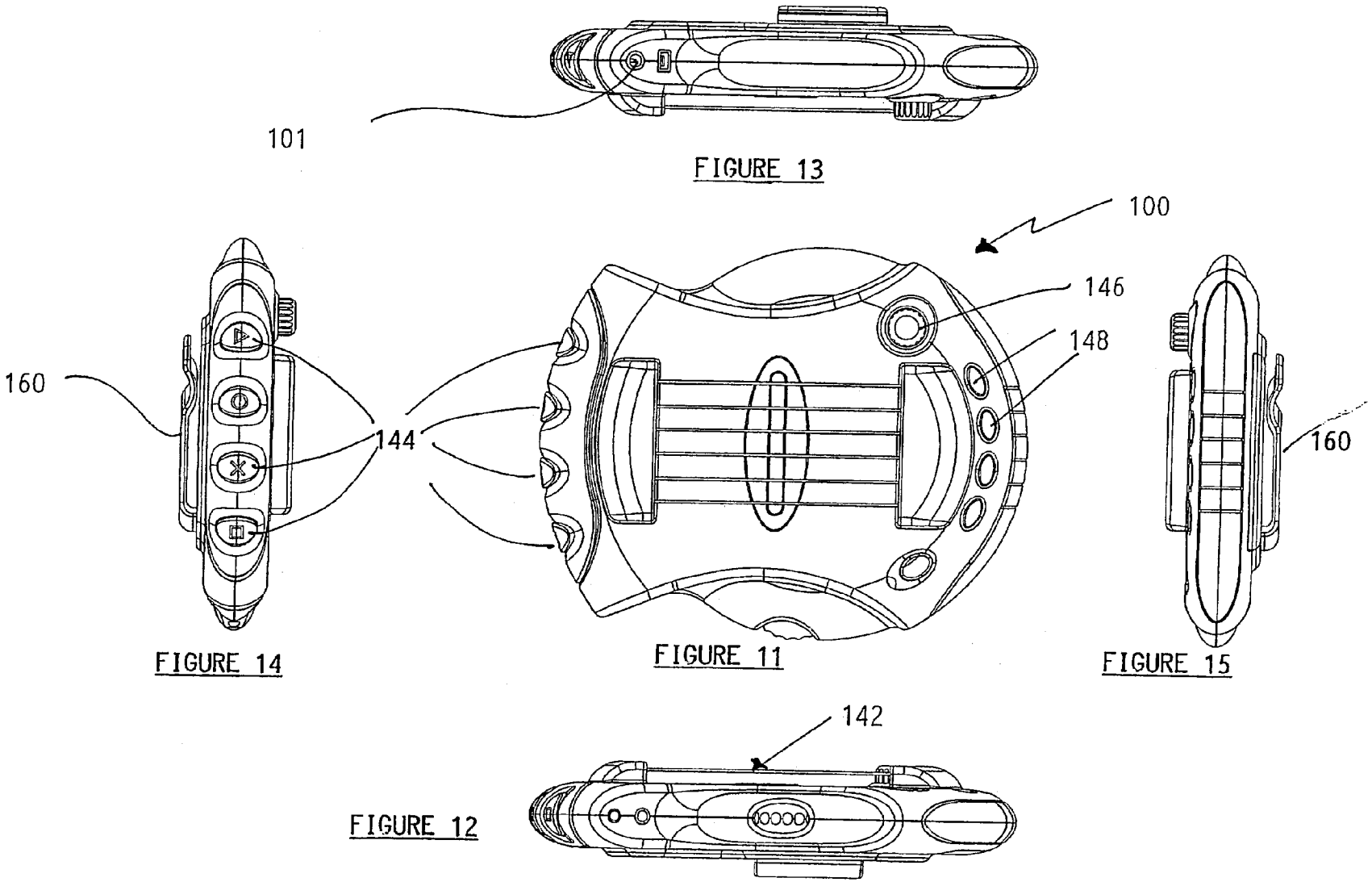
FIG. 11 is a plan view of the assembled portable unit as shown in FIG. 10.
FIGS. 12 to 15 are two side views and two end views respectively of the portable unit.

Referring to the drawings and now to FIG. 9, there is shown a schematic diagram for the remaining section of the circuitry connecting the switches on the guitar 41 to the P.C. or games console. Switches 91 to 94 correspond to the four positions of the control pad 48 whereby pressing of any of the four switches alters the value of resistance on pin 3 of the 15 pin D-plug which is seen by the bios via the input port. Pressing switch 91 or 92 shorts out the associated resistors whereas pressing switch 93 or 94 switches in the associated resistors respectively. The bios of the P.C. monitors the value of resistance at pin 3 and stores the value in RAM. The software provided for the guitar interface accesses the values stored in RAM to locate a cursor on the mask of the software interface. The input from pin 3 is effectively the x value of a standard XY co-ordinate system used to locate a cursor on the screen of a monitor.

Switches 96, 97, 98 and 99 correspond to the selection buttons 44 on the shaft of the guitar 41 and operate in the same way as the switches 91 to 94. The value of resistance provided at pin 6 is recorded by the bios of the P.C. and is interpreted by the software provided for the guitar interface. The value provided by pin 6 is associated with a y co-ordinate when the port is used with a standard joystick and can be used in a similar way with the guitar 41. The variable resistors 101 and 102 correspond to the volume control knob 46 and the wow handle 45. Again, the bios of the P.C. reads the value of resistance provided by the two variable resistors 101, 102 and the software interprets the value to provide an audible output at the selected volume or pitch. Switches 105, 110 and 111 are recognised by the software on the control unit as special effects switches and can be assigned a variety of functions. The fuse 115 protects the control unit from any faults that may occur on the guitar 41. Customized driver software is also provided with the instrument in order to avoid the need for calibration.

Referring to FIGS. 10 to 15, the portable unit 100 includes the features of the other embodiments and can be used with headphones or miniature speakers (not shown) which can be plugged into outlet port 101. The portable unit 100 has a guitar like device which includes strings 142 and a transducer 143. Selection buttons 144, special effects controls 148 and volume control 146 enables the user to control the output and effects generated by playing the device in conjunction with a CD playing in the CD holder 150. A clip 160 enables the portable unit 100 to be attached to a user's belt or clothing who can play the unit at whatever location he or she wishes.

It will of course be understood that the invention is not limited to the specific details as herein described, which are given by way of example only, and that various alterations and modifications may be made without departing from the scope of the invention as defined in the appended claims.

The invention claimed is:

1. An interactive multimedia apparatus comprising:

(a) a computer gaming peripheral input device (CGPID) operable by a user to convert simulated-musical-instrument-playing movements into an electrical output signal;

(b) a source of at least one pre-recorded music track; and (c) a control unit connected to i. said source of at least one pre-recorded music track to receive at least one pre-recorded music track, and ii. said CGPID to receive said electrical output signal and modify said pre-recorded music track in response to said electrical output signal to produce a musical output signal, said control unit analyzing said pre-recorded music track to provide output during periods when said pre-recorded music track is silent, said control unit generating said musical output signal based on said analysis output file and in agreement with at least one of a structure and a melody of a main track in response to said user operating said CGPID at least one of at the wrong time and incorrectly.

2. An interactive multimedia apparatus as claimed in claim 1, in which the at least one pre-recorded music track is downloadable in at least one of MP3 format, wav format, and any other file format for storing audio information digitally.

3. An interactive multimedia apparatus as claimed in claim 1, in which the source of at least one pre-recorded music track comprises an instrumental track from a selection of available tracks, whereby an operator may download a piece of music with any track removed and download that track separately to play along with the musical output signal.

4. An interactive multimedia apparatus as claimed in claim 1, in which software in the control unit starts a main track and streams a backing track in mute synchronization with the main track and when the software receives the electrical output signal from the CGPID, the software outputs the musical output signal.

5. An interactive multimedia apparatus as claimed in claim 1, in which the control unit detects at least one of length, amplitude, and frequency of the electrical output signal received from the CGPID and in which the control unit adjusts the pre-recorded music track in response to the electrical output signal from the CGPID.

6. An interactive multimedia apparatus as claimed in claim 1, in which the control unit comprises software adapted to algorithms.

7. An interactive multimedia apparatus as claimed in claim 1, in which the control unit is operable by user activated control members which send a signal to software of the control unit in response to being pressed.

8. An interactive multimedia apparatus as claimed in claim 7, in which each control member has an associated file stored in the control unit, whereby in use, the user activates the control member and the control unit opens the associated file and plays the file for a length and at an amplitude in response to an electrical signal received from a transducer as a result of the user's activation of a string of the CGPID.

9. An interactive multimedia apparatus as claimed in claim 1, further comprising special effect controls which when operated by the user send signals to the control unit to produce special effects on the musical output signal.

10. An interactive multimedia apparatus as claimed in claim 9, wherein the CGPID comprises a guitar or a guitar type device operable by the use and comprises strings and a transducer to convert strumming of the strings into the electrical output signal.

11. An interactive multimedia apparatus as claimed in claim 10, wherein the guitar or guitar type device includes a control panel, selection controls, a volume control and the special effect controls.

12. An interactive multimedia apparatus as claimed in claim 10, further comprising an interface for sending the electrical output signal generated by the transducer to the control unit, the interface being provided between the transducer and the control unit, the interface enabling the user to transmit a plurality of different control signals to the control unit.

13. An interactive multimedia apparatus as claimed in claim 12, wherein the interface includes an amplifier and level detectors adapted to detect a force with which the user strums or strikes the strings.

14. An interactive multimedia apparatus as claimed in claim 1, further comprising a storage device adapted to store the musical output signal to at least one of a hard disk, a compact disk, and a DVD device.

15. An interactive multimedia apparatus as claimed in claim 1, further comprising visual display screens which are operable to enable the user to at least one of launch a game experience, select different operating modes, choose a source music device, select a backing track, and assign digital sound effects files to the special effects controls on the CGPID.

16. An interactive multimedia apparatus as claimed in claim 1, wherein the CGPID is connectable to at least one of a joystick port, USB port, and RS232port of at least one of a personal computer and games console.

17. An interactive multimedia apparatus as claimed in claim 1, wherein the CGPID is connectable to a microphone input/output connection of the control unit.

18. An interactive multimedia apparatus as claimed in claim 1, wherein the control unit comprises at least one of a personal computer, a cable television decoder, a satellite television decoder, and a games console, wherein the apparatus further comprises an audio/audio-visual means that comprises at least one of a mono high fidelity audio apparatus, stereo high fidelity audio apparatus, headphones, television, and monitor.

19. An interactive multimedia apparatus comprising:

(a) a computer gaming peripheral input device (CGPID) operable by a user to convert simulated-musical-instrument-playing movements into an electrical output signal;

(b) a source of at least one pre-recorded music track; and (c) a control unit connected to i. said source of at least one pre-recorded music track to receive at least one pre-recorded music track, and ii. said CGPID to receive said electrical output signal and modify said pre-recorded music track in response to said electrical output signal to produce a musical output signal, said control unit analyzing said pre-recorded music track to provide output during periods when said pre-recorded music track is silent, said control unit generating said musical output signal based on said analysis output file and in agreement with at least one of a structure and a melody of a main track in response to said user operating said CGPID at least one of at the wrong time and incorrectly, the control unit being operable by user activated control members which send a signal to software of the control unit in response to being pressed, each control member having an associated file stored in the control unit, whereby in use, the user activates the control member and the control unit opens the associated file and plays the file for a length and at an amplitude in response to an electrical signal received from a transducer as a result of the user's activation of at least one string of the CGPID.

* * * * *